US006233979B1

(12) United States Patent
Plath

(10) Patent No.: US 6,233,979 B1
(45) Date of Patent: May 22, 2001

(54) CIRCULAR KNITTING MACHINE FOR PRODUCTION OF KNITWEAR WITH SELECTIVELY DIFFERENT CHARACTERISTICS AND METHOD OF ADJUSTING IT

(75) Inventor: Ernst-Dieter Plath, Albstadt (DE)

(73) Assignee: Sipra Patententwicklungs- und Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 09/567,480

(22) Filed: May 9, 2000

(30) Foreign Application Priority Data

May 19, 1999 (DE) ..... 199 23 802

(51) Int. Cl.[7] ..... D04B 15/66
(52) U.S. Cl. ..... 66/232; 700/141
(58) Field of Search ..... 66/8, 13, 215, 66/54, 57, 125 R, 132 R, 132 T, 231, 232, 237, 238; 700/141

(56) References Cited

U.S. PATENT DOCUMENTS

| | | | | |
|---|---|---|---|---|
| 3,983,370 | * | 9/1976 | Caspi et al. | 364/470.12 |
| 4,763,492 | * | 8/1988 | Tibbals, Jr. | 66/232 |
| 5,375,435 | * | 12/1994 | Gille et al. | 66/211 |
| 5,388,050 | * | 2/1995 | Inoue et al. | 64/470.02 |
| 5,862,682 | * | 1/1999 | Maenaka et al. | 66/75.2 |

FOREIGN PATENT DOCUMENTS

| | | | | |
|---|---|---|---|---|
| 2 012 085 | | 1/1971 | (DE) . | |
| 24 36 401 | | 3/1975 | (DE) . | |
| 26 31 858 | | 2/1977 | (DE) . | |
| 32 32 643 A1 | | 3/1984 | (DE) . | |
| 38 27 453 C1 | | 10/1989 | (DE) . | |
| 40 12 204 A1 | | 10/1991 | (DE) . | |
| 42 40 037 A1 | | 6/1994 | (DE) . | |
| 0 652 314 A1 | | 5/1995 | (DE) . | |
| 39 31 997 C2 | | 8/1998 | (DE) . | |
| 197 33 266 A1 | | 2/1999 | (DE) . | |
| 19733236 | * | 2/1999 | (DE) | 66/232 |
| 19733266 | * | 2/1999 | (DE) | 66/232 |
| 0652314 | * | 5/1995 | (EP) | 66/232 |
| 1 359 679 | | 7/1974 | (GB) . | |

* cited by examiner

*Primary Examiner*—Danny Worrell
(74) *Attorney, Agent, or Firm*—Michael J. Striker

(57) ABSTRACT

A circular knitting machine is described whose components can be adjusted to meet an order with the aid of adjustment data sets stored in a data memory and which relate to a predetermined knitting structure, yarn type, yarn thickness and quality of the knitwear to be produced and preferably arise from knitting processes already carried out on the circular knitting machine. A basic adjustment is preferably first effected on the basis of the adjustment data and can be followed by a fine adjustment with a central adjusting device for the loop size, until the desired quality is attained. (FIG. 1).

21 Claims, 7 Drawing Sheets

E24 Single Jersey

Fig. 6

| 1 | 2 | 3 | 4 | | | | 5 | | | | 6 | | | | 7 | | | | 8 | | 9 | 10 | | | 11 |
|---|---|---|---|---|---|---|---|---|---|---|---|---|---|---|---|---|---|---|---|---|---|---|---|---|---|
| | | | 1 | 2 | 3 | 4 | 1 | 2 | 3 | 4 | 1 | 2 | 3 | 4 | 1 | 2 | 3 | 4 | 1 | 2 | | | Z1 | Z2 | |
| Baumwolle 34/1 | 93 | 7 | 1237 | | | | 6 | | | | 25 | | | | 247 | | | | 20 | 20 | 5.0 | 30 | 96 | 28 | 106 |
| | 105 | 9 | 1109 | | | | 5 | | | | 21 | | | | 222 | | | | 20 | 20 | 5.0 | 11 | 96 | 28 | 106 |
| | 120 | 11 | 946 | | | | 6 | | | | 16 | | | | 185 | | | | 20 | 20 | 5.0 | 4 | 96 | 28 | 109 |
| | 135 | 13 | 840 | | | | 6 | | | | 12 | | | | 164 | | | | 20 | 20 | 5.0 | 10 | 86 | 40 | 109 |
| | 150 | 16 | 769 | | | | 6 | | | | 8 | | | | 150 | | | | 20 | 20 | 5.0 | 6 | 86 | 40 | 112 |
| | 170 | 19 | 665 | | | | 6 | | | | 3 | | | | 130 | | | | 20 | 20 | 5.0 | 12 | 72 | 54 | 112 |
| Baumwolle 40/1 | 80 | 7 | 1244 | | | | 5 | | | | 24 | | | | 245 | | | | 20 | 20 | 5.0 | 25 | 96 | 28 | 106 |
| | 90 | 9 | 1017 | | | | 6 | | | | 17 | | | | 199 | | | | 20 | 20 | 5.0 | 15 | 96 | 28 | 106 |
| | 105 | 13 | 820 | | | | 6 | | | | 8 | | | | 161 | | | | 20 | 20 | 5.0 | 14 | 86 | 40 | 112 |
| | 120 | 15 | 747 | | | | 6 | | | | 6 | | | | 145 | | | | 20 | 20 | 5.0 | 9 | 86 | 40 | 112 |
| | 135 | 18 | 712 | | | | 5 | | | | 5 | | | | 199 | | | | 20 | 20 | 5.0 | 4 | 86 | 40 | 112 |
| | 150 | 22 | 660 | | | | 5 | | | | 3 | | | | 123 | | | | 20 | 20 | 5.0 | 10 | 72 | 54 | 112 |
| Baumwolle 50/1 | 65 | 7 | 1197 | | | | 6 | | | | 24 | | | | 235 | | | | 20 | 20 | 5.0 | 21 | 98 | 28 | 100 |
| | 80 | 11 | 871 | | | | 6 | | | | 12 | | | | 170 | | | | 20 | 20 | 5.0 | 19 | 86 | 40 | 100 |
| | 95 | 15 | 722 | | | | 6 | | | | 5 | | | | 140 | | | | 20 | 20 | 5.0 | 8 | 86 | 40 | 100 |
| | 110 | 18 | 653 | | | | 6 | | | | 3 | | | | 126 | | | | 20 | 20 | 5.0 | 13 | 72 | 54 | 103 |
| | 120 | 20 | 612 | | | | 6 | | | | 2 | | | | 118 | | | | 20 | 20 | 5.0 | 9 | 72 | 54 | 105 |
| | 133 | 26 | 564 | | | | 6 | | | | 2 | | | | 109 | | | | 20 | 20 | 5.0 | 4 | 72 | 54 | 107 |
| | 140 | 33 | 525 | | | | 6 | | | | 2 | | | | 101 | | | | 20 | 20 | 5.0 | 1 | 72 | 54 | 108 |
| Baumwolle 60/1 | 60 | 10 | 942 | | | | 6 | | | | 15 | | | | 185 | | | | 20 | 20 | 5.0 | 29 | 86 | 40 | 100 |
| | 65 | 12 | 833 | | | | 6 | | | | 10 | | | | 163 | | | | 20 | 20 | 5.0 | 16 | 86 | 40 | 100 |
| | 70 | 17 | 675 | | | | 6 | | | | 4 | | | | 131 | | | | 20 | 20 | 5.0 | 5 | 86 | 40 | 100 |
| | 80 | 18 | 644 | | | | 6 | | | | 3 | | | | 125 | | | | 20 | 20 | 5.0 | 3 | 86 | 40 | 105 |
| | 90 | 20 | 624 | | | | 6 | | | | 2 | | | | 121 | | | | 20 | 20 | 5.0 | 1 | 86 | 40 | 108 |

E24 3:1 Einfach-Futter

Fig. 7

| 1 | 2 | 3 | 4 | | | | 5 | | | | 6 | | | | 7 | | | | 8 | | 9 | 10 | | | 11 |
|---|---|---|---|---|---|---|---|---|---|---|---|---|---|---|---|---|---|---|---|---|---|---|---|---|---|
| | | | 1 | 2 | 3 | 4 | 1G | 2F | 3 | 4 | 1G | 2F | 3 | 4 | 1G | 2F | 3 | 4 | 1G | 2F | | | Z1 | Z2 | |
| | 159 | 8 | 1043 | 326 | | | 6 | 11 | | | 20 | 5 | | | 205 | 136 | | | 20 | 42 | 7.0 | 18 | 72 | 54 | 114 |
| Baumwolle | 175 | 9 | 921 | 326 | | | 5 | 11 | | | 12 | 5 | | | 180 | 136 | | | 20 | 42 | 7.0 | 15 | 72 | 54 | 110 |
| Nm 34/1 | 198 | 12 | 816 | 324 | | | 6 | 11 | | | 8 | 5 | | | 160 | 136 | | | 20 | 42 | 7.0 | 6 | 72 | 54 | 110 |
| | 229 | 14 | 745 | 326 | | | 6 | 11 | | | 5 | 5 | | | 146 | 136 | | | 20 | 42 | 7.0 | 3 | 72 | 54 | 110 |
| Nm 18/1 | 271 | 17 | 663 | 326 | | | 6 | 11 | | | 1 | 5 | | | 129 | 136 | | | 20 | 42 | 7.0 | 11 | 54 | 72 | 110 |
| | | | | | | | | | | | | | | | | | | | | | | | | | |
| | 136 | 8 | 1073 | 326 | | | 5 | 11 | | | 20 | 5 | | | 211 | 136 | | | 20 | 42 | 7.0 | 24 | 72 | 54 | 113 |
| Baumwolle | 168 | 10 | 904 | 326 | | | 6 | 11 | | | 12 | 5 | | | 177 | 136 | | | 20 | 42 | 7.0 | 12 | 72 | 54 | 113 |
| Nm 40/1 | 188 | 12 | 820 | 326 | | | 6 | 11 | | | 8 | 5 | | | 166 | 136 | | | 20 | 42 | 7.0 | 7 | 72 | 54 | 113 |
| | 215 | 15 | 747 | 326 | | | 6 | 11 | | | 5 | 5 | | | 146 | 136 | | | 20 | 42 | 7.0 | 4 | 72 | 54 | 110 |
| Nm 18/1 | 240 | 16 | 679 | 326 | | | 5 | 11 | | | 1 | 5 | | | 132 | 136 | | | 20 | 42 | 7.0 | 14 | 54 | 72 | 110 |
| | 296 | 20 | 614 | 311 | | | 5 | 11 | | | 1 | 5 | | | 119 | 130 | | | 20 | 42 | 7.0 | 9 | 54 | 72 | 110 |
| | 121 | 8 | 1052 | 330 | | | 6 | 11 | | | 20 | 5 | | | 207 | 138 | | | 20 | 42 | 7.0 | 23 | 72 | 54 | 112 |
| Baumwolle | 151 | 10 | 888 | 330 | | | 6 | 11 | | | 12 | 5 | | | 174 | 138 | | | 20 | 42 | 7.0 | 12 | 72 | 54 | 110 |
| Nm 50/1 | 165 | 11 | 816 | 330 | | | 6 | 11 | | | 8 | 5 | | | 160 | 138 | | | 20 | 42 | 7.0 | 8 | 72 | 54 | 110 |
| | 183 | 13 | 745 | 330 | | | 6 | 11 | | | 5 | 5 | | | 146 | 138 | | | 20 | 42 | 7.0 | 28 | 72 | 72 | 110 |
| Nm 18/1 | 221 | 16 | 664 | 330 | | | 6 | 11 | | | 1 | 5 | | | 129 | 138 | | | 20 | 42 | 7.0 | 14 | 54 | 72 | 110 |
| | 248 | 19 | 608 | 310 | | | 6 | 11 | | | 1 | 5 | | | 118 | 129 | | | 20 | 42 | 7.0 | 9 | 54 | 72 | 110 |

CIRCULAR KNITTING MACHINE FOR PRODUCTION OF KNITWEAR WITH SELECTIVELY DIFFERENT CHARACTERISTICS AND METHOD OF ADJUSTING IT

BACKGROUND OF THE INVENTION

1. Field of the Invention

This invention relates to a circular knitting machine for producing a knitwear with selectively different characteristics, comprising a control device having a keyboard, a display unit and a memory for data pertaining to the knitwear and a plurality of components in the form of a cam arrangement with individually adjustable cam parts forming knitting points, a central adjusting device for simultaneous adjustment of a loop size at all knitting points and a yarn a feed device having positive yarn feeds rolls associated individually with the knitting points and at least one drive device for these rolls adjustable to a selected yarn feed amount.

2. Description of the Prior Art

Circular knitting machines of this kind as a rule comprise adjustable and/or interchangeable cam parts forming individual knitting points, in order to be able to produce knitwear with different knitting structures or knit patterns (e.g. DE 39 37 93 C2, DE 40 12 204 A1, DE 42 40 037 A1). Moreover lowering (drawn-down) cam parts are provided for adjusting the stitch size to meet requirements and can be individually adjusted to a selected lowering depth with the aid of adjusting bolts or the like mounted rotatably in the cam supports. Alternatively or additionally, a central adjusting device can be provided, with which the axial position of a knitting needle carrier, e.g. a needle cylinder, can be suitably altered relative to a knock-over edge or relative to another knitting implement support, e.g. a dial or a sinker ring (e.g. DE 26 31 858 A1, DE 32 32 643 A1, EP 0 652 314 A1). The cam parts as a rule have to be adjusted manually, while the central adjusting device is mostly provided with an automatic drive and can be adjusted by means of the input keyboard of a control device of the circular knitting machine.

The yarn feed to the individual knitting points is effected in the circular knitting machines initially referred to with positive yarn feed devices, since contrary to Jacquard machines the amount of yarn or the yarn length consumed at any knitting point per revolution of the needle carrier or cam arrangements is always exactly the same. The yarn feed devices are mostly driven by a common drive belt, which is for its part driven by a drive roller with variable diameter, in order to be able to select the amount of yarn supplied in accordance with requirements (e.g. DE 39 31 997 C2, DE 197 33 266 A1), while the alteration of the diameter of the drive roller can be effected manually or automatically through the keyboard of the control device. In order to measure and/or check the set yarn amount and/or the yarn tension resulting from this, there serve for example manual measuring rollers or measuring rollers mounted on the circular knitting machine and associated with at least one selected yarn (e.g. DE 24 36 401 A1, DE 38 27 453 C1) or feelers (DE 20 12 08 A1, DE 34 31 743 C2). It also known in this connection to control or regulate the amount of yarn which is fed in dependence on a measured value, e.g. the yarn tension, in that the transmission ratio or diameter of the drive roller is suitably acted on for example (e.g. DE 28 20 747 A1, DE 197 33 263 A1).

Knitting machines of this kind and their components described above make it possible to make the same kinds of knitting structures with different parameters (e.g. diameter of the needle cylinder, gauge or needle spacing), furthermore with different yarns, i.e. kinds of yarn or yarn thickness, and/or with different qualities, where as a rule and hereinbelow "quality" is understood as the weight of the knitwear per unit area, especially per square meter, called the square meter weight. If it is assumed, in order to simplify the understanding, that the machine parameters in a selected circular knitting machine remain unchanged, the characteristics of the knitwear produced on a circular knitting machine are thus described or defined essentially by the features of knitting structure, type of yarn, yarn thickness and quality.

In order to carry out a knitting order in a knitting factory, after selection of the knitting machine, the knitting structure and the yarn, it is necessary on the one hand to mount or adjust the cam parts at the knitting points in question adapted to make the selected knitting structure, on the other hand so to adjust the abovementioned and possible numerous further components (e.g., fabric spreaders, fabric take-down devices, etc.) that knitwear results whose quality corresponds as accurately as possible to the order.

Although the machine parameters, the yarn, the knitting structure and the quality are fixed by the order, such adjustment of the circular knitting machine has till now been a troublesome and time-consuming operation, which requires a great deal of experience of the operator. A main reason for this is that the single value to be set, namely the quality, is given in units appropriate to the person giving the order, namely the square meter weight of the knitwear, which can neither be accurately preset by adjustment of the components nor measured during the knitting process. It is indeed generally known that the quality can also be defined in units which the operator of the circular knitting machine needs for adjustment of say the yarn feed device and the take-down device, namely the yarn length to be fed per revolution of the needle cylinder or fed to the cam system and/or the number of loop rows per centimeter in the finished knitwear and that these values have a defined relationship with the square meter weight. It is further known that an increase in the yarn length per revolution (or per selected number of knitting needles) leads to the loops becoming larger and thus the square meter weight and the number of rows of loops per centimeter becoming smaller. Conversely, a reduction on the yarn length per revolution results in a reduction of the loops and thus an increase in the number of loop rows per centimeter and in the square meter weight. Finally, it is known that only the yarn length per revolution can reliably be adjusted, namely with the aid of the yarn feed device components, and the number of loop rows per centimeter and the square meter weight have to be found by trial. However, up until now, there has been no usable mathematical description for these characteristic properties, i.e. it is not possible to compute the yarn length per revolution and/or the number of loop rows per centimeter directly from the square meter weight or vice versa.

On account of these circumstances, the quality of knitwear has been described until now by the square meter weight, which is particularly important to the person giving the order. As a result, the operator begins the adjustment of a circular knitting machine as a rule by mounting the cam parts and assignment of the required yarns and yarn feed rolls to the various knitting points, while following this he estimates what yarn lengths per revolution are required for the various knitting points or how large the lop count per centimeter can be, which is important for the take-down device, on the basis of the prescribed square meter weight.

On the basis of these estimates the lowering depth of the lowering cam parts, the central adjusting device, the yarn tensions, the take-down device and other possibly present components are then adjusted. When all adjustments have been made, a sample is made from knitwear produced with these adjustments and tested by weighing the sample to see whether the required square meter weight results. If this is not the case, the described adjustments are altered as often as needed to get the desired square meter weight or less by chance.

The described adjustments of the various components are partially facilitated in modern circular knitting machine in that they can be effected e.g. by electro-mechanical, electromagnetic, pneumatic and/or hydraulic means from the control panel of a customary control device and can be entered by means of a keyboard. However, this does not alter the fact that the operator is forced in implementing any order to repeat or change the described adjustments as often as is required for the knitwear to have the prescribed quality.

Against this background, the invention is based on the object of so designing the circular knitting machine described above that the time and the number of steps to be carried out for adjusting the components is reduced.

A further object is to simplify and speed up the method of adjusting of the various components of the knitting machine.

Yet another object of this invention is to standardize the steps for adjusting of the various components.

A further object of this invention is to design the knitting machine and its control device such that adjustment data sets associated with knitwears having preselected characteristics and arising from experience can be used for adjusting the various components of the knitting machine.

These and other objects underlying this invention are solved with a knitting machine the control device of which is arranged for entry and storing and for output and display of a plurality of adjustment data sets for the components, wherein each adjustment data set leads to knitwear with predetermined characteristics.

A method of adjusting a circular knitting machine in accordance with this invention is characterized in that a basic adjustment of the circular knitting machine is first produced using the machine adjustment data supplied by the control device, the square meter weight of the knitwear arising with this basic adjustments determined and a fine adjustment of the circular knitting machine is effected in the event of deviation from a prescribed square meter weight, until the quality of the knitwear corresponds substantially to the prescribed square meter weight.

The invention is based on the consideration that, with the manufacturer of a knitting machine and also in a knitting factory, numerous tests are made and orders met, which lead to adjustment data for the various components which is mostly troublesome to acquire but is very accurate. According to the invention this adjustment data arising from experience is used and so entered in a memory associated with the knitting machine in question that any knitwear with predetermined characteristics has its own associated adjustment data set for the various machine components. The operator can refer back to already existing adjustment data when meeting an order. Since this has provided to be correct in previous knitting processes, the operator can arrive at the right adjustments comparatively quickly. Moreover it is possible to make the once determined adjustment data sets available to all circular knitting machines of the same type. If no adjustment data set is available for any knitting order, the operator can start from an adjustment data set which has been obtained in the production of knitwear which comes closest to the knitwear to be produced. If this data set leads to knitwear which differs from the knitwear specified in the order only in the quality, this can mostly be altered to the desired value comparatively quickly using the central adjusting device. Added to this, it would naturally also be possible to store and use adjustment data sets which can be derived not directly from knitting processes already carried out but from other knowledge.

Further advantageous features of the invention appear from the dependent claims.

BRIEF DESCRIPTION OF THE DRAWINGS

The invention will now be explained in more detail in conjunction with the accompanying drawings of an embodiment, wherein:

FIGS. 6 and 7 show examples of adjustment data sets for adjusting the circular knitting machine according to FIG. 1.

DETAILED DESCRIPTION OF THE INVENTION

The circular knitting machine according to the invention is explained below with reference to an embodiment considered the best at present. In order to simplify the showing and avoid repetition, mention is made of numerous references, those being incorporated by reference in the subject matter of the present disclosure.

Figure 1:
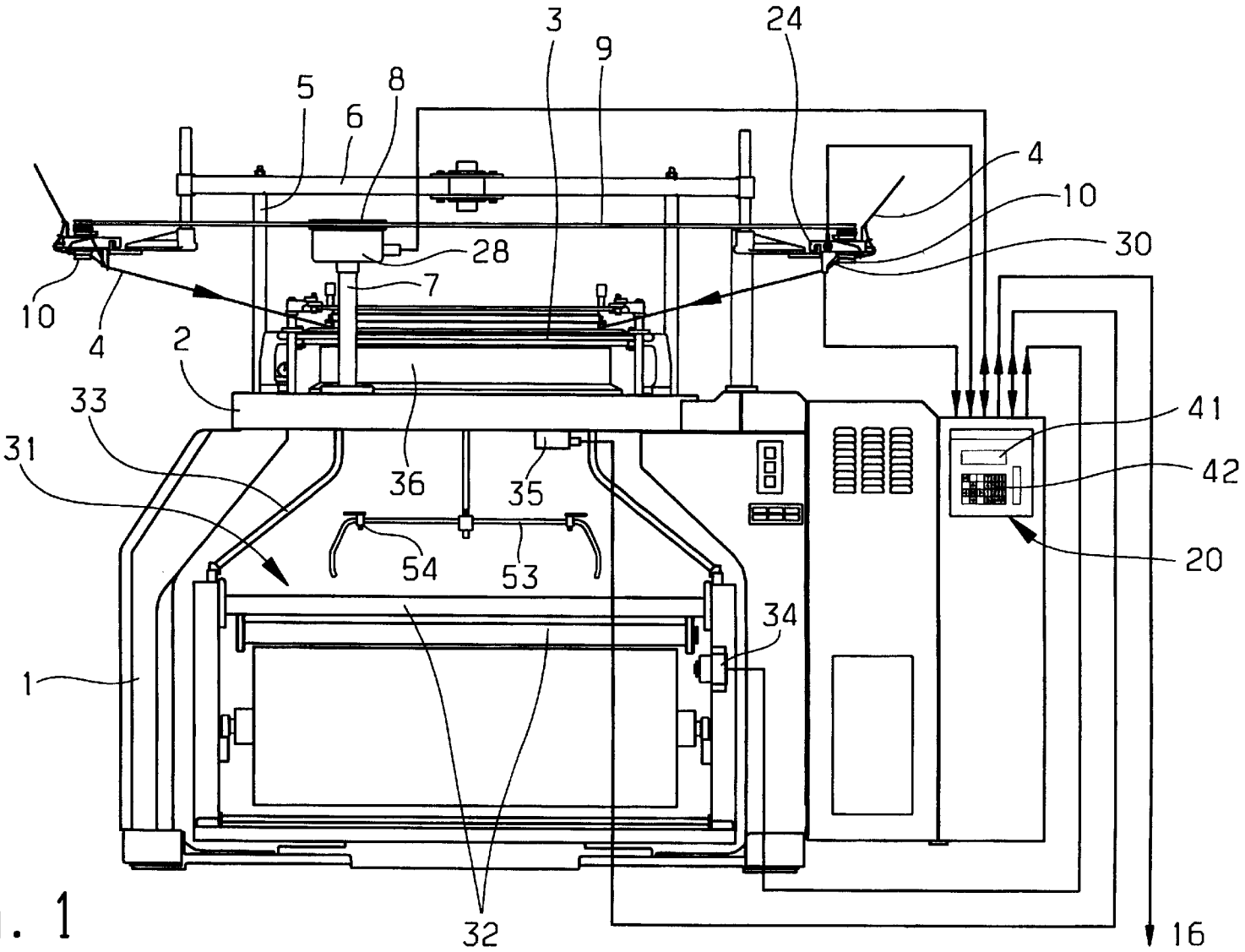
FIG. 1 is a highly schematic front view of a circular knitting machine according to the invention, with the components needed for understanding of the invention, only shown schematically however.
Figure 2:
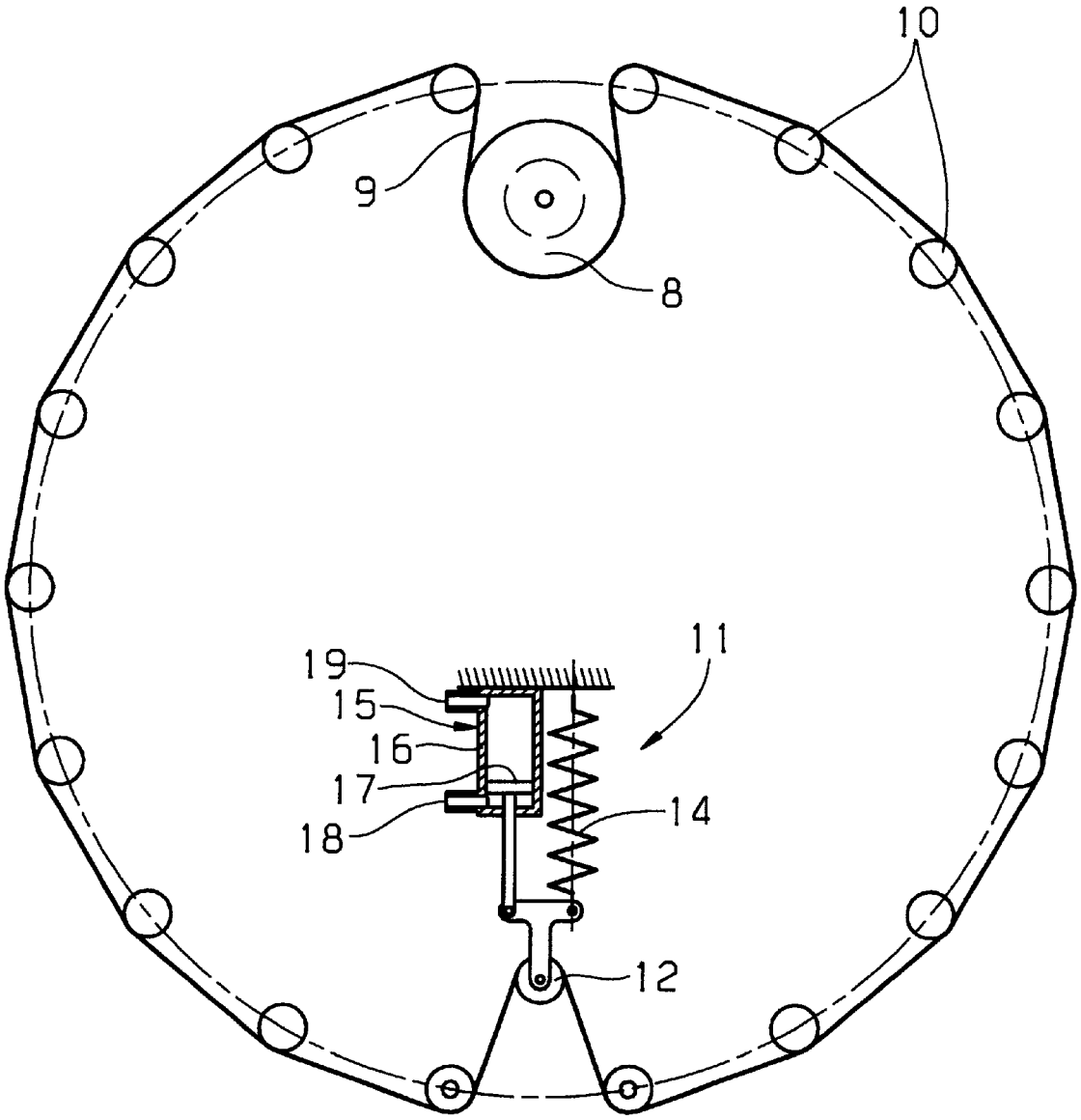
FIG. 2 shows a component of the circular knitting machine adapted to adjust the amount of yarn per revolution, schematically in plan view.
Figure 3:
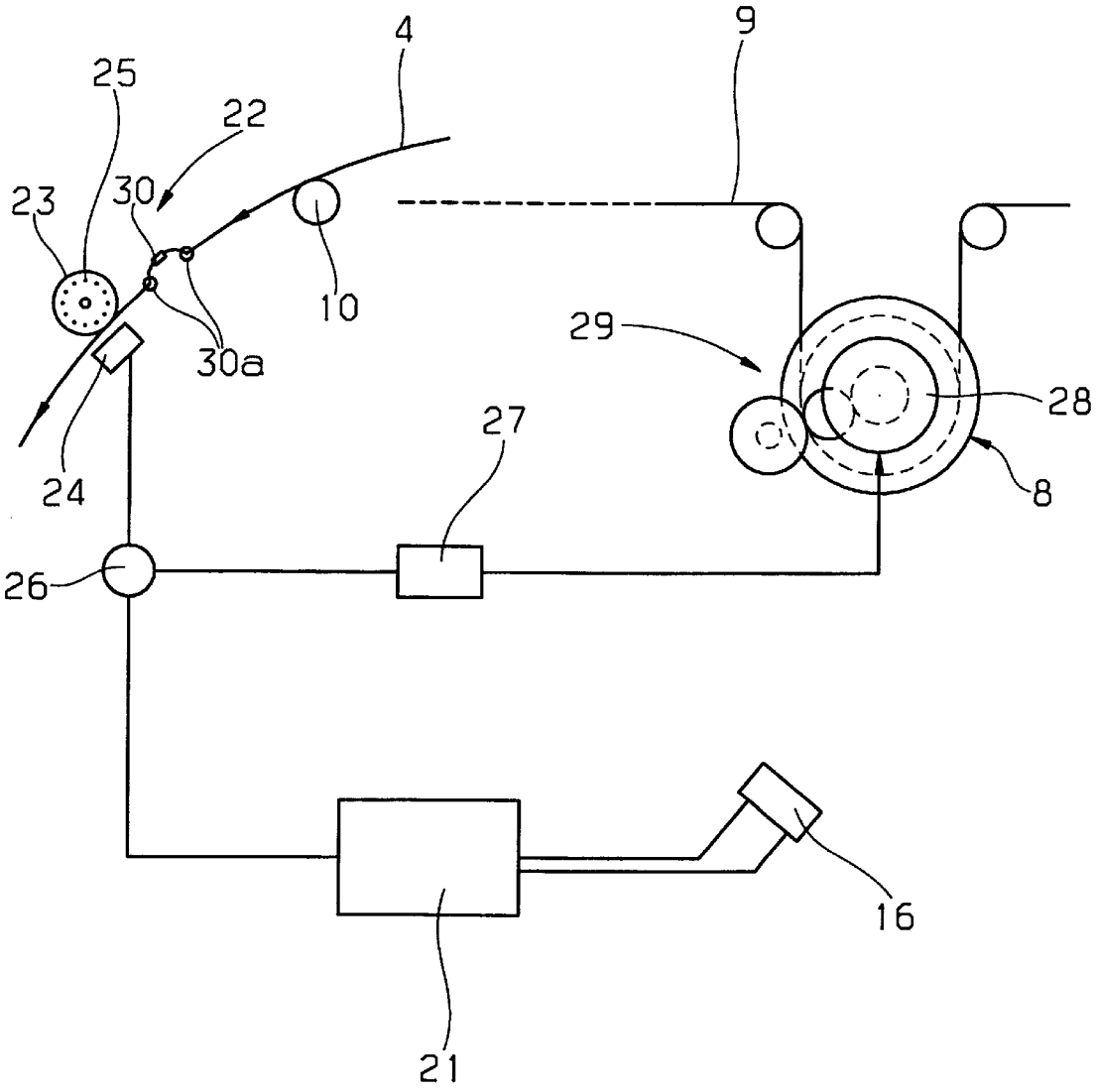
FIG. 3 is a schematic block circuit diagram of circuit of a control device of the circular knitting machine according to FIG. 1 adapted to control the amount of yarn.

According to FIGS. 1 to 3, a circular knitting machine suitable for the purposes of the invention is designed as in DE 197 33 263 A1. It comprises a frame 1 with a baseplate 2 and a needle cylinder 3 mounted rotatably thereon. Beside the frame 1 is a creel, not shown, for yarn bobbins, from which yarns 4 are drawn and fed in the direction of the arrow to the knitting needles mounted in the needle cylinder 3.

A yarn feed device is supported on the frame 1 by means of supports 5 and/or a support ring 6 carried by these. It includes a support tube 7 fixed on the baseplate 2 and in which a shaft is rotatably mounted, projecting out of the support tube 7 at both ends. The lower end of the shaft in FIG. 1 is driven by a transmission not shown in detail with a predetermined transmission ratio and synchronously with the needle cylinder 3. Moreover the yarn feed device includes a drive roller 8 fixed on the other end of the shaft, with a peripheral section on which an endless drive belt 9 bears over a predetermined wrap angle. This belt bears at least partially on the periphery of pulleys, which are fixed on the drive shafts of driven yarn feed rolls 10, which are mounted rotatably in the housings of yarn feed devices or feed wheel mechanisms fixed on the supports 5 or in the support ring 6 and feed the yarn positively, i.e. without slip to the knitting points associated therewith. Obviously any other known kinds of positive yarn feed devices could by provided.

As FIG. 2 further shows, the drive belt 9 running over the drive roller 8 can be kept tensioned by a tensioning device 11, preferably operating automatically and including for example a guide roller 12 at least partially wrapped by the drive belt 9 and biased by a tensioning spring in engagement therewith or a weight acting thereon.

In order to alter the effective diameter of the peripheral section of the drive roller 8 wrapped by the drive belt 9 this roller comprises for example two preferably plane parallel discs, one of which is connected rotationally fast with the shaft arranged in the support tube 7 (FIG. 1), e.g. by means of a key or the like. The other disc spaced from this and coaxial therewith is rotatably mounted relative to the first disc. The first disc comprises grooves running radially from the shaft in its lower surface, facing the second disc, whereas the second disc is provided with at least one spiral groove in its upper side associated with the first disc. In between the two discs are arranged sliders which form the periphery or peripheral surface of the drive roller 8 and server to support the drive belt 9. The effective diameter of the periphery of the drive roller 8 can be altered in that the sliders mounted in the grooves by means of pins, projections or the like are moved radially outwards or inwards by turning the two discs relative to one another.

Drive rollers 8 of this kind, which are frequently called regulating discs or quality wheels, and their function are generally known (preferably DE 197 33 266 A1) and do not therefore need to be described in more detail.

FIG. 2 shows the drive roller 8 and the drive belt 9 in an operating position with the greatest diameter, which can be reduced to the smallest diameter indicated in broken lines. Accordingly the tensioning spring 14 in FIG. 2 is less strongly contracted and the guide roller 12 is moved less far radially inwards than would be the case with production of the smallest diameter of the drive roller 8, whereby the drive belt 9 is essentially tensioned equally, in spite of the different diameters of the drive roller 8, and is kept in slip-free engagement with the various rollers and guide rolls.

If the diameter of the drive roller 8 is to be altered it is normally necessary to slacken the drive belt 9 by disabling the guide roller 12 or tensioning spring 14. In the particularly preferred circular knitting machine suitable for the invention, a control or switchable tensioning member 15 is provided for this, connected to the guide roller 12, consisting of a pneumatic cylinder/piston actuator, which is fixed at one end to a fixed part of the machine frame 1 or the like and which includes a cylinder 16, a piston 17 which can reciprocate therein and a piston rod fixed to this, with its end projecting out of the cylinder 16 connected to the guide roller 12.

The cylinder 16 provided at its two ends with a connection port 18, 19 for a pneumatic pressure medium, e.g. air, through which the tensioning member 15 can be controlled. In particular the control is such that the piston rod is either biased into its fully extended position (FIG. 2) and the drive belt 9 is thereby slackened, so that the diameter of the drive roller 8 can be altered, or in the direction of its fully retracted position, so that the drive belt 9 is kept tensioned.

If the adjustment of the diameter of the drive roller 8 is to be possible automatically or semi-automatically from a control panel 20 (FIG. 1) of the circular knitting machine, a circuit for the cylinder 16 is connected to an output of a control device 21 (FIG. 3) normally present in circular knitting machines, fitted below the control panel 20. The control device 21 in this case provides for example control signals which are fed to the adjusting device (e.g. DE 197 33 266 A1) for the diameter alteration of the drive roller 8, and on the other hand and at the correct times before and after the diameter alteration, provides switching signals for the cylinder 16, which produce the desired belt tension for each particular case.

FIG. 3 shows how an adjustment of the drive roller 8 can be effected and the amount of yarn supplied to the circular knitting machine by means of the feed rolls 10 can be controlled with the aid of the tensioning device according to FIG. 2. Only one feed roll 10 is shown in FIG. 3, which is driven as in FIGS. 1 and 2 by the drive belt 9, here only shown in part in broken lines, and which feeds the yarn 4 (cf. also FIG. 1) to the circular knitting machine.

A measuring device 22 is shown in the region of the yarn 4 for detecting the amount of yarn fed to the circular knitting machine by the feed roll 10. The measuring device 22 includes e.g. a measuring roller 23 which is wrapped by the yarn 4 and has holes 25 which can be sensed by an opto-electronic sensor 24 and are spaced in the peripheral direction. Alternatively the row of holes could be replaced by permanent magnets or other means and the sensor 24 be of inductive or other design. Yarn measuring devices and devices associated therewith for converting the amounts of yarn fed into electrical signals are generally known to the man skilled in the art (e.g. DE 21 27 953 A1, DE 24 36 401 A1 or DE 38 27 453 C1).

The sensor 24 is connected to a circuit arrangement, not shown in detail, and issues at its output an actual value signal, which is characteristic of the instantaneously fed yarn amount. This preferably electrical signal is compared in a comparator 26 with a set-point (nominal) signal, which is supplied e.g. from the control device 21 or a set-point transducer contained therein with an adjustable set-point value, where this set-point value can also be adjusted, e.g. through the control panel 20 by the operator. The difference value determined by the comparator 26 is fed to a regulator 27, which generates a positioning signal fed to a positioning device 28 for the drive roller 8 such that the supplied yarn amount always corresponds to the set-point value determined by the control device 21. The adjusting device 28 can comprise an electric motor, especially a servo or stepping motor, for this purpose, which acts through a summing gear 29 on the drive roller 8 (DE 197 33 266 A1). This same control device 21 can so issue control signals that the tension of the drive belt 9 is altered at the right times before or after an alteration of the diameter of the drive roller 8 commanded by the control device 21. This leads to the advantage that the amount of yarn to be supplied can be adjusted, kept constant and monitored from the central control panel 20 or the like, easily and conveniently to the operator, both when the circular knitting machine is stationary and when it is running.

Alternatively or additionally it can be provided to control or regulate the changing, keeping constant and monitoring of the diameter of the drive belt 8 with the aid of a sensor 30 (FIG. 3) measuring the yarn tension. In a particularly preferred embodiment this sensor 30 includes a guide element arranged between two yarn eyes 30*a* and fitted with a strain measuring strip, where the strain measuring strip provides an analog electrical signal in dependence on the force which acts thereon from the yarn 4 fed between the yarn eyes 30*a*.

The circular knitting machine according to FIG. 1 further comprises a take-down device 31, which has at least two take-down rolls 32, which grip the circularly knitted knitwear therebetween and draw it down. A positive take-down device is especially well suited to the purposes of the present invention, which draws the fabric down not with a predetermined force but with a selected amount of fabric per revolution of the needle cylinder or of the cam arrangement. The basis for this is that the amounts of knitwear occurring in the circular knitting machines considered here is always substantially the same. If just as much fabric is taken down as is produced by the circular knitting machine, the take-down force is accordingly zero, whereas if more fabric is taken down than is produced, a definite take-down force greater than zero occurs on account of the elasticity of the knitwear.

The take-down rollers 32 are driven in circular knitting machines with rotating needle cylinders for example in that the take-down device 31 is coupled to a rotating needle cylinder support ring through entraining arms and the rotary movement of the take-down rollers 32 is generated by a gearbox for example, which engages with a toothed ring arranged at the bottom of the frame 1. The gearbox can be regulated for manual setting of the take-down amount and is provided with an adjusting knob 34 (FIG. 1) or the like. If the adjustment is to be effected from the control panel 20, a drive motor which can rotate in two directions, especially a servo-motor or stepping motor can be associated with the adjusting knob 34.

Take-down devices of this kind are generally known and need not therefore be explained in more detail (preferably DE 93 04 846 U1 for example).

A winding up device for the knitwear is moreover provided below the take-down device 31 but this is of no importance for the purposes of the invention.

A circular knitting machine suitable for the purposes of the invention further comprises a central adjusting device for the loop size (preferably EP 0 652 314 A1), which includes a reversible motor 35, e.g. a servo or stepping motor, which serves to adjust the axial distance of the needle cylinder 3 from a dial or sinker ring, not shown. The motor 35 can be controlled in the embodiment from the control panel 20 through a corresponding line.

Finally, the circular knitting machine includes a cam arrangement 36 surrounding the needle cylinder 3, with a plurality of cam parts which act on knitting implements, especially knitting needles, slidably mounted in the needle cylinder 3 and form a plurality of knitting points round the periphery of the needle cylinder 3, with each of which is associated at least one of the yarn feed rolls 10. The cam or lock parts arc with particular advantage fixed on segments forming the cam arrangement 36, which e.g. comprise all cam parts for a knitting point and can be easily exchanged when required. Moreover, each segment is provided with at least one lowering or draw-down part, with which is associated an adjusting bolt mounted rotatably in the segment, in order to adjust the lowering depth and thus the loop size individually, independently of the central adjusting device (e.g. DE 40 12 204 A1).

Figure 4:
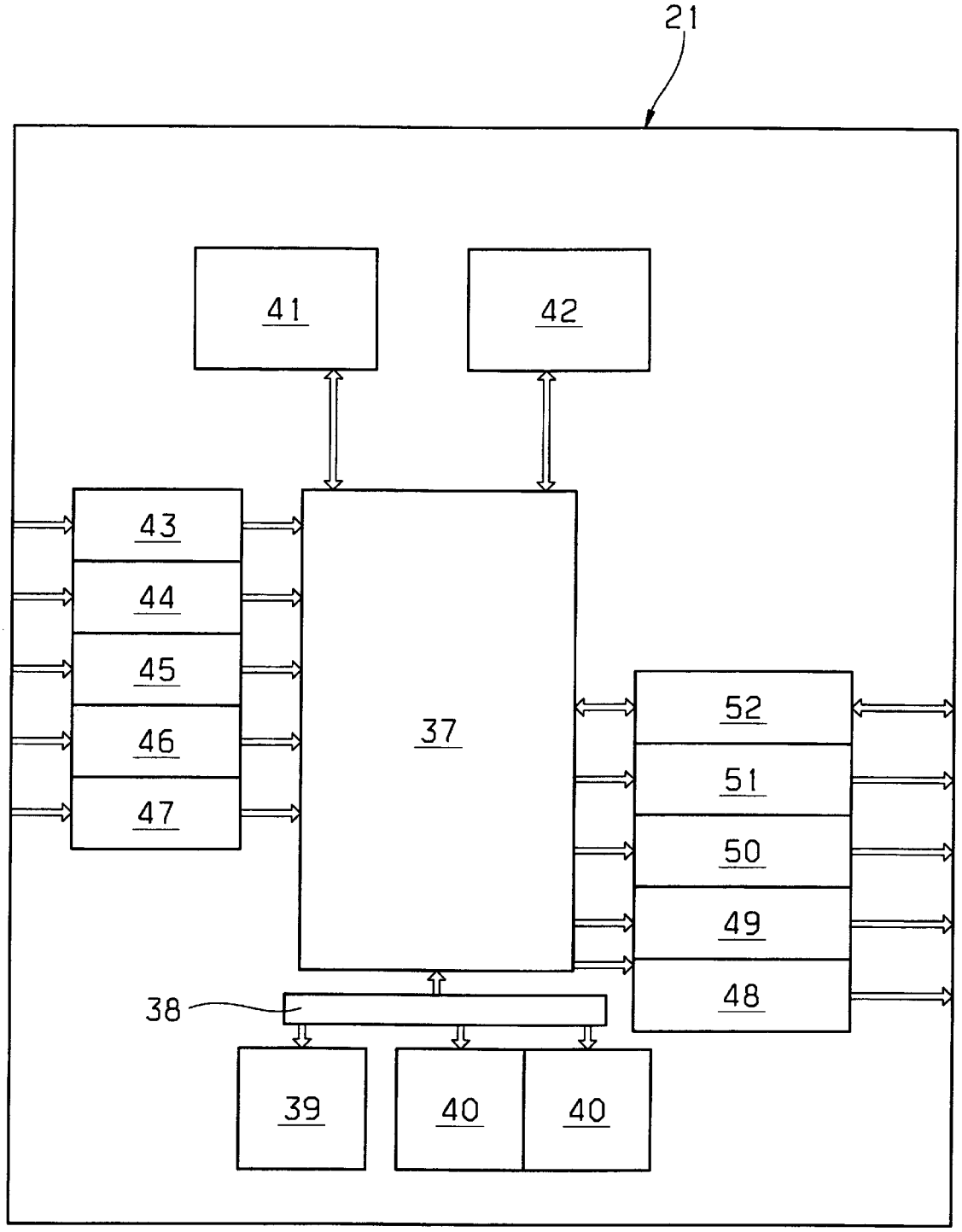
FIG. 4 is a block circuit diagram of a micro-controller forming the control device of the circular knitting machine.

In accordance with the invention, the control device 21 according to FIG. 4 comprises a normal micro-controller. This includes a processor 37, to which a data and address bus 38 is connected, this being connected to a program memory 39 and at least one data memory 40, e.g. formed as RAM, for reception of machine adjustment data. The processor 37 is moreoever provided with a display unit or display 41 and a keyboard 42 (cf. also FIG. 1). Furthermore the processor 37 has a plurality of analog or digital inputs, which are connected for example to sensors indicated in FIGS. 1 and 3. One input 43 is connected to the sensor 24, one input 44 to the sensor 30, one input 45 to a sensor of the positioning device 28 for the drive roller 8 and a further input 46 to a sensor associated with the motor 35 for the central adjusting device. A further input 47 is finally connected to a clock pulse generator normally provided in circular knitting machines, which emits one zero pulse per revolution of the needle cylinder or the cam arrangement, which zero pulse can be used inter alia for computing the yarn length per revolution. Finally, the processor 37 has a number of analog or digital outputs. An output 48 is connected to the drive member for the positioning device 28 of the drive roller 8, an output 49 to a circuit for controlling the cylinder 16 of the belt tensioning device 11, an output 50 to the motor 35 for the central adjusting device, an output 51 to a stop-motion, not shown, for the circular knitting machine and a further output 52 to a customary computing and control unit which makes it possible to display data on the display 41, to call and to control by means of the keyboard 42 the program entered in the program memory 39 and when required to use data read out from the data memory 40 via the outputs 48, 49 and 50 to control the components connected thereto.

Figure 5:
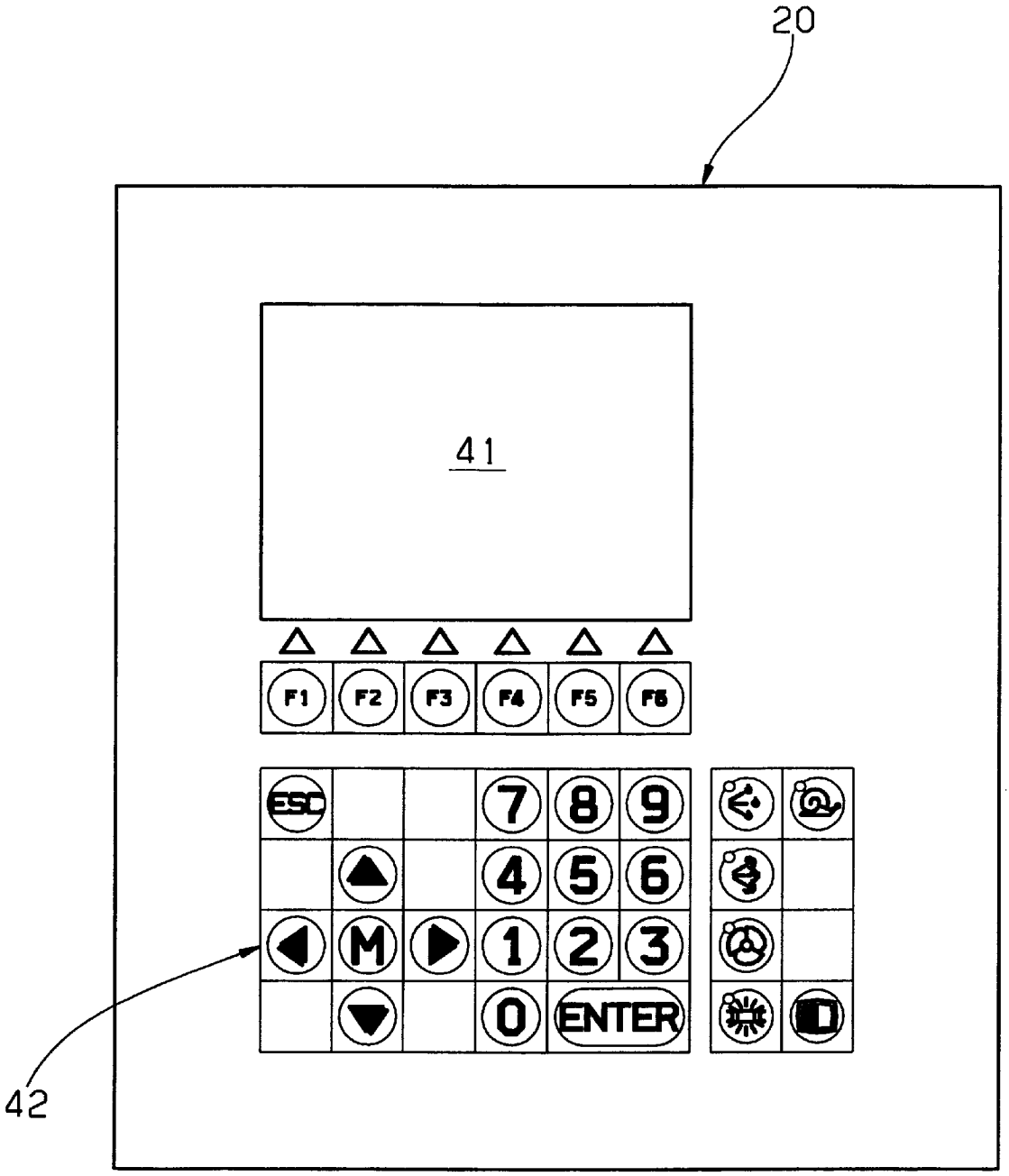
FIG. 5 shows a keyboard for the micro-controller according to FIG. 4.

FIG. 5 shows by way of example the parts of the control panel 20 concerning the invention, especially the display unit 41 and the keyboard 42. The keyboard has inter alia numerical keys 0–9, keys marked with arrows, by means of which the program stored in the program memory 39 can be executed, an M-key, by means of which a jump can be made back to the beginning of the program, a plurality of F-keys for calling different programs and an ENTER key, by means of which the machine adjustment data appearing in the display unit 41 is transferred to the associated components.

The memory 40 serves in accordance with the invention to hold a plurality of adjustment data sets for the described components of the circular knitting machine, where each adjustment data set corresponds to a particular knitwear which can be produced on the circular knitting machine. These adjustment data sets are preferably written into the data memory whenever, in executing a knitting order, as a result of test runs with the circular knitting machine or otherwise, the adjustment data contained in the set leads to knitwear with reproducible properties. By way of example only, the adjustment data sets for two different pieces of knitwear are shown in FIGS. 6 and 7. Both relate to knitwear which has been produced on the same circular knitting machine with a rotating needle cylinder of 30 inch diameter and fineness (needles per inch) of E24, i.e. with fixed machine parameters and therefore have a predetermined width and number of loop wales. An essential difference is that knitwear with "Single jersey" knitting structure is involved in FIG. 6 and with the "3:1 single fleece" knitting structure in FIG. 7. In the case of the knitwear according to FIG. 6 each available knitting point (e.g. 96) forms one loop row (systems per repeat=1) while in the case of FIG. 7 four knitting points are involved in the formation of one loop row (systems per repeat=4).

In column 1 of FIGS. 6 and 7 the yarn and yarn thickness employed are given, where the yarn kind is the same throughout (cotton), while the yarn thickness in Nm has different values (e.g. 40/1, i.e. 40 m yarn weights 1 g).

The square meter weight in grams is give in column 2, from which the loop rows per centimeter given in column 3 and the yarn lengths to be fed in centimeters per revolution of the needle cylinder given in column 4 result, in dependence on the yarn. Columns 2 to 4 thus give the quality of the knitwear in all three of the units explained above.

Column 5 contains data for adjusting the yarn tension at the knitting points present, in grams, yarn tensions of 5 g or 6 g being provided here predominantly.

Column 6 contains the setting for the lowering depth of the lowering parts (draw-down cams). The numbers given mean graduations on a scale associated with the adjusting bolts for the lowering depth of the lowering parts. Data for adjusting the drive roller 8 is contained in column 7. Here also graduations on a scale or other such data is involved, which is known to the user of the circular knitting machine. The same applies to the instructions contained in column 10 for the adjustment of the take-down device 31.

The data contained in columns 8, 9 and 11 can initially be disregarded. It will be explained further below.

From FIGS. 6 and 7 it is seen that the data memory 40 (FIG. 4) contains 41 different data sets in the example, which hold the machine adjustment data for 41 items of knitwear in all. The characteristics of the knitwear appear in each case in columns 1–4 while columns 5–11 contain adjustment data, which has been found usable in conjunction with these characteristics.

The adjustment of the circular knitting machine for making knitwear with the characteristics seen in FIGS. 6 and 7 is explained below in more detail with reference to row 10 of FIG. 6 and in conjunction with the program preferably held in the program memory 39.

It is assumed that there is an order to produce knitwear with a cotton yarn Nm 40/1 in the Single jersey knitting structure and a square meter weight of 120 g/m$^2$. The program of the control device 21 is started for this purpose, e.g. by actuation of the M-key (FIG. 5), whereupon the following main menu for example appears on the display 41:

1. Display and readjustment
2. Basic adjustment
3. Alter quality
4. Entry and display of data Only the menu lines 1–3 are significant for the purposes of the invention. Line 4 serves the purpose of entering in the memory the machine adjustment data for a newly arrived knitwear not yet present in the data memory 40.

The menu line 1 of the program is now called through the keyboard 42. After entering the characteristic data for the knitwear (cotton Nm 40/1, 120 g/m$^2$, Single jersey) or simply a code number for the order or the knitwear concerned, the following display for example is present on the display 41:

Pattern name: XX

Loop count: 15 loops/cm

Central adjusting device 40

Yarn length: 747 cm/rev

Yarn tension: 6 g.

On the basis of this display the central adjusting device is first adjusted to a mean value of 40, for which purpose the circular knitting machine is switched on for a short time if necessary, in order to rotate the needle cylinder 3 slowly and bring the motor 35 gradually to the required value. The sensor associated with the motor 35 indicates attainment of the desired value "40" on the display 41. Then a switch is made to menu line 2 (basic adjustment). This shows on its first page e.g.:

Pattern name: XX

Knitting structure: Single jersey

Use change lock parts: System 1 ZA1 System 2 ZA2 etc.

On the basis of these instructions the available knitting points are provided with the required cam parts. Alternatively the setting into which the lock parts should be brought, could equally be shown, if it is a cam arrangement with adjustable, instead of interchangeable cam parts which is involved.

The next page of the menu item "basic setting" shows for example:

Pattern: XX

Yarn length per revolution: 747 cm/rev.

This means that the drive roller 8 is now to be adjusted to a diameter which corresponds to a yarn feed amount of 747 cm per revolution of the needle cylinder and that all knitting points are, in the absence of other instructions, to be supplied with this amount of fed yarn. The operator will now therefore firstly thread up the yarns appropriately and feed it to the knitting points, the yarns being passed uniformly around the associated yarn feed rolls 10.

The adjustment of the drive roller 8 is then effected. This is preferably done in two stages. In the first stage a coarse adjustment is effected with the needle cylinder 3 stationary; in the ideal case the indicated value 747 cm/rev is confirmed by actuation of the ENTER key and the adjustment is thereby carried out automatically by the positioning device 28 or the summing gear 29, in that the computer of the control device 21 automatically converts the value of 747 cm/rev into suitable control signals for the drive roller 8. Alternatively a manual adjustment could equally be effected on the basis of scale markings or the like, which is tedious however. In a second stage a fine adjustment is effected, in that the circular knitting machine is turned on and the needle cylinder 3 is rotated slowly. The setting of the drive roller 8 is then gradually altered or adjusted until signals from the sensor 24 show that precisely the desired yarn amount of 747 cm/rev is being fed.

At this time the positioning device 28 is thus regulated with the sensor 24 and the yarns 4 are preferably only laid once around the yarn feed rolls 10, so that a certain amount of slip is possible and breaking of the yarns 4 is avoided in the case of abrupt alterations in the diameter of the drive roller 8. All these advantageous precautions can be shown to the operator via the menu.

An essential advantage of the described adjustment is that the control device 21 automatically supplies the yarn amount of 747 cm/rev known on the basis of earlier adjustments for the selected square meter weight of 120 g/m$^2$ and this no longer has to be found tediously, as previously.

A further program page of the basic adjustment requires the operator to set the lowering depth of the various lowering lock parts, e.g. as follows:

Adjust lowering depth

| System | Lowering depth |
|---|---|
| 1 | 6 graduations |
| 2 | 6 graduations, etc. |

where these values relate to the previously produced mean value of 40 for the central adjusting device.

The take-down device 31 is adjusted with a further menu page (cf. Row 10 of FIG. 6), which can be effected automatically or manually by the adjusting knob 34, depending in the nature of the take-down device 31. The display is as follows for example:

Adjust take-down

Loop count: 15 loops/cm.

A further substantial advantage of the invention is that the control device 21 can provide directly the loop row count per centimeter (here 15/cm) pertaining to the fabric with the square meter weight of 120 g/m$^2$, from the previously obtained and stored adjustment data, so that this value, which cannot be computed directly from the supplied square meter weight does not have first to be tediously determined. Depending on the case the instruction of 15/cm suffices to enable the operator to adjust the take-down device.

If required the tension of the knitwear can be checked manually with the circular knitting machine rotating slowly and be corrected slightly if necessary.

Finally it is necessary to adjust the lowering depth of all take-down cam parts individually so that the yarn tension has the required value of 6 g at all points. The display corresponds essentially to the display of the first menu page, i.e. the corresponding program page requires that the same yarn tension of 6 g is obtained at all knitting points.

The operator must now manually adjust the yarn tension to 6 g at each individual knitting point, with the needle cylinder 3 rotating slowly and the yarn feed device switched on. A hand measuring apparatus for the yarn tension customary in the trade is used for this in known manner, being for example like tension measuring devices which can be mounted on circular knitting machines (e.g. DE 20 12 085 A1). Moreover the yarn 4 must previously be laid several times about the associated yarn feed rolls 10, e.g. 20 turns, in order to prevent any slip during the adjustment of yarn tension.

The circular knitting machine is now ready for operation and is in a basic setting determined by the data memory 40 for the machine adjustment data. It can now be used to produce the required knitwear, without any kind of regulation being necessary. In particular the control circuit containing the sensor 24 can be rendered inoperative by actuating an associated F-key. The described example has been based (row 10 in FIG. 6) on the situation in which the adjustment data which pertain to the knitwear specified in the order are already held in the memory 40. In the case in which this is not so, the control device 21 is so arranged and formed that, on entry of knitwear with characteristics for which there is no machine adjustment data, the adjustment data for knitwear is shown whose characteristics come closest to the characteristics which are selected or to be reproduced. In other words the program searches in all already stored adjustment data sets for that which appears the best for the knitwear to be produced.

If for example it is required that the square meter weight be 125 g/m$^2$, instead of 120 g/m$^2$ as contained in FIG. 6, or 135 g/m$^2$, the basic setting of the circular knitting machine is firstly effected on the basis of the data set which comes closest, here a square meter weight of 120 g/m$^2$ contained in row 10 in FIG. 6. Following this a fine adjustment takes place, in that line 3, "Alter quality" in the main menu denoted above is selected. The display is then as follows for example:

Alter quality

Pattern name: XX

Central positioning device: 40 in steps of 1/100 mm

Yarn tension tolerance: 2 g.

In order to alter the quality only the central positioning device is used for example and for preference. Since it is know that the square meter weight increases when more loop rows per centimeter are formed, i.e. the needles are lowered less deeply or the yarn length per revolution is reduced, the operator can easily estimate by how many graduations the central positioning device should be altered, in order to achieve the required square meter weight. Alternatively, it could be provided in the program that the display supplies an estimate in the nature of how much and in what direction the adjusting device must be altered in order to obtain an alteration of the square meter weight by ±1 g, or what alteration is achieved with each possible step of 1/100 mm.

In order to make unneccessary a renewed alteration by the operator of the diameter of the drive roller 8 in this fine adjustment of the circular knitting machine, the control device 21 is converted by means of one of the F-keys to regulation of the drive roller 8 by means of the sensor 30 for the yarn tension. The diameter of the drive roller 8 is then automatically altered correspondingly to maintain the predetermined yarn tension, optionally with the tolerance of 2 g specified in the last menu item. This regulation can then be turned off again. The take-down device must moreover be matched to the new value of loop rows/cm.

Alternatively only the drive device 8, 9 of the yarn feed device can be used to alter the quality. If the operator can estimate for example the amount by which the yarn length per revolution of the needle cylinder must be altered, on the basis of the abovementioned relationship, in order to achieve the necessary alteration in the square meter weight, it would also be possible in the embodiment firstly to alter from the control panel 20 the yarn length per revolution of 747 cm/rev prescribed in the above embodiment. In order not to have to readjust the central setting device in this case, the motor 35 is advantageously so regulated in dependence on the yarn tension that the yarn tension remains substantially constant. The motor 35 is advantageously connected in a control circuit like that in FIG. 3 for this purpose. After producing the desired quality this control circuit is rendered inoperative again.

In a last method step a sample of the knitwear obtained with the said adjustments is removed manually and weighed, in order to check the square meter weight. If it agrees with the required value, the machine adjustment is finished, otherwise a slight correction must be undertaken with the aid of the central adjusting device. This can be correspondingly undertaken when the basic adjustment already includes the required square meter weight (e.g. row 10 in FIG. 6).

The adjustment data obtained in the described manner can be entered in the data memory 40 with the aid of line 4 of the main menu, in order either to correct the existing data set or to enlarge the collection according to FIGS. 6 and 7 by a further data set. It is apparent that ever more and ever more accurate data sets will be obtained in this way over the course of time and can be used generally for all circular knitting machine of a specific type (e.g. diameter 30", fineness 24).

A further correction can be provided in order to avoid problems which can arise from heating in continuous operation of a circular knitting machine (e.g. alteration of the lowering depth through thermal expansion). Compensation can then be effected with the aid of the central adjusting device, where however alteration of the diameter of the drive roller 8 must be avoided in this case, in order to let the square meter weight stay the same.

The output 51 of the processor 37 (FIG. 4) leading to a stop-motion for the circular knitting machine receives a stop signal for example when it is found by means of the sensor 24 that the supplied amount of yarn falls outside a predetermined tolerance window during continuous operation of the circular knitting machine. One reason for this can be too much build up of dirt on the drive roller 8 or too little tension in the drive belt 9, causing slip. The fault in question can be corrected in timely manner, without faults occurring in the knitwear.

The invention is not limited to the described embodiment, which can be modified in numerous ways. In particular, it is possible to integrate the sensors 24 and 30 in one of the participating yarn feed devices, in order to save space. Moreover numerous further components of the circular knitting machine can be adjusted in the described way. This applies for example to a conventional fabric spreader 53 in FIG. 1, which is provided with positioning screws 54 and can have its length altered. The program could therefore specify for example the measurement to which the fabric spreader 53 must be set, in an additional menu item (column 11 in FIGS. 6 and 7). The same applies when the circular knitting machine has a sinker cam, which can be rotated relative to the needle cylinder 3 about the central axis and can be adjusted. Column 9 in FIGS. 6 and 7 serves for this for example.

Furthermore it can be seen from FIG. 7 that, with knitwear with characteristics other than those described, two or more values can appear alongside one another in column 7. These values are needed when a circular knitting machine is provided with two or more independent drive belts 9 spaced from one another, each of which is driven from a separate drive roller 8 and when the order requires for example that base (ground) threads of the knitting for example are fed with a different yarn length per revolution than say laying-in threads. In this case the respective yarn feed rolls 10 are connected selectively to one of the two drive belts 9 with the aid of manual or electrically actuated clutches (preferably DE 41 16 497), which leads to the pairs of values shown in columns 4 to 6 of FIG. 7. Moreover it is clear that in this case an associated sensor 24 or 30 is required for each drive belt 9 or each drive roller 8.

It would further be possible to drive the drive shafts of the drive rollers 8 with the aid of gearwheel drives, which include interchangeable gears, so that different ranges of adjustment for the yarn lengths to be fed per revolution can be selected (column 8 in FIGS. 6 and 7). Here also corresponding adjustment data can be provided in the data memory 40 with associated program pages. The program in the program memory 39 should always contain the adjustment data necessary for adjusting all components of a circular knitting machine and further be adapted to lead the user by steps through the program, until all adjustments are made. It is further clear to the man skilled in the art that many of the described components can be formed and be controllable differently, and the invention can naturally also be implemented in a circular knitting machine with a stationary needle cylinder and rotating cam segment ring. Finally it will be understood that the various features and method steps can also be used in combinations other than those illustrated and described.

It will be understood that each of the elements described above, or two or more together, may also find a useful application in other types of constructions differing from the types described above.

While the invention has been illustrated and described as embodied in a circular knitting machine and a control device therefor, it is not intended to be limited to the details shown, since various modifications and struktural changes may be made without departing in any way from the spirit of the present invention.

Without further analysis, the foregoing will so fully reveal the gist of the present invention that others can, by applying current knowledge, readily adapt it for various applications without omitting features that, from the standpoint or prior art, fairly constitute essential characteristics of the generic or specific aspects of this invention.

What is claimed as new and desired to be protected by Letters Patent is set forth in the appended claims.

What is claimed is:

1. A circular knitting machine for producing a knitwear with selectively different characteristics, comprising: a control device (21) having a keyboard (42), a display unit (41) and a memory for data pertaining to the knitwear and a plurality of components in the form of a cam arrangement (36) having individually adjustable cam parts forming knitting points, a central adjusting device for simultaneous adjustment of a loop size at all knitting points, and a yarn feed device having positive yarn feed rolls (10) and at least one drive device (8, 9) for these rolls adjustable to a selected yarn feed amount, wherein said control device (21) is arranged for entry and storing and for output and display of a plurality of adjustment data sets (FIGS. 6, 7) for the components, and wherein each adjustment data set leads to knitwear with predetermined characteristics.

2. A circular knitting machine according to claim 1, wherein said control device (21) is designed as a user guide such that, after entering a selected knitwear, adjustment data pertaining to said selected knitwear are indicated in a predetermined sequence.

3. A circular knitting machine according to claim 2, wherein said sequence can be altered and/or selected.

4. A circular knitting machine according to claim 1, wherein said characteristics of the knitwear can be specified by at least one of features of knitting structure, type of yarn, yarn thickness and quality.

5. A circular knitting machine according to claim 1, wherein adjustment data of said adjustment data sets are adapted to machine parameters.

6. A circular knitting machine according to claim 1, wherein plurality of machine adjustments data sets are stored in the data memory (40), which emanate from knitting processes carried out on the circular knitting machine.

7. A circular knitting machine according to claim 1, wherein said control device (21) is designed and arranged for displaying, on entry of a selected knitwear for which no machine adjustment data is contained in the memory (40), machine adjustment data which pertain to another knitwear already present in the memory and whose characteristics come closest to the selected knitwear.

8. A circular knitting machine according to claim 1, wherein said control device (21) is designed and arranged for using displayed adjustment data for automatic adjustment of the associated components.

9. A circular knitting machine according to claim 8, wherein said drive device (8, 9) for the yarn feed device is arranged to accept stored adjustment data.

10. A circular knitting machine according to claim 8, wherein central adjusting device is arranged to accept stored machine adjustment data.

11. A circular knitting machine according to claim 8 and further comprising a take-down device (31) arranged to accept stored machine adjustment data.

12. A circular knitting machine according to claim 1, wherein data said adjustment data sets include at least one of the following instructions: nature and/or arrangement of the cam parts at the knitting points, setting of the cam parts and/or of the central adjusting device, kind of association of the yarn feed rolls (10) with the knitting points, size of the yarn tensions to be set at the knitting points, setting of a fabric spreader (53) and/or setting of a take-down device (31).

13. A circular knitting machine according to claim 1, wherein data of said adjustment data sets include an entry for the set number of loop rows per centimeter in the knitwear in operation.

14. A circular knitting machine according to claim 1, wherein data said adjustment data sets include an entry for the yarn lengths to be fed per revolution at the knitting points.

15. A circular knitting machine according to claim 1, wherein said control device (21) includes means for selective regulation of the drive device (8, 9) of the yarn feed device in dependence on the feed amount and/or the yarn tension.

16. A method of adjusting a circular knitting machine for producing a knitwear with selectively different characteristics and comprising a control device (21) having a memory for data pertaining to the knitwear and a plurality of components in the form of a cam arrangement (36) having adjustable can parts, a central adjusting device for simultaneous adjustment of a loop size and a yarn feed device having positive feed rolls (10) and at least a drive device (8, 9) for these rolls (10) for adjusting a selected yarn feed amount, said method including the steps of storing a plurality of adjustment data sets (FIGS. 6, 7) in said memory, each adjustment data set including adjustment data for so adjusting said components that knitwear of predetermined characteristics is knitted, providing first a basic adjustment of said components by using a preselected adjustment data set, determining a square meter weight of the knitwear arising with this basic adjustment and effecting a fine adjustment of the components in case of deviation from a prescribed square meter weight, until the quality of the knitwear corresponds substantially to a prescribed square meter weight.

17. A method according to claim 16, wherein said fine adjustment is effected by means of the central adjusting device.

18. A method according to claim 17, wherein said fine adjustment is carried out while regulating the drive device (8, 9) of the yarn feed device in dependence on a yarn tension.

19. A method according to claim 16, wherein said fine adjustment is effected by means of the drive device (8, 9) of the yarn feed device.

20. A method according to claim 19, wherein said fine adjustment is carried out while regulating the central adjusting device (motor 35) in dependence on a yarn tension.

21. A method according to claim 16 for adjusting a circular knitting machine also having a take-down device (31) and further comprising the step of correcting if necessary adjustment of the take-down device (31) after the fine adjustment is effected.

* * * * *